United States Patent [19]

Garrison

[11] Patent Number: 5,041,246

[45] Date of Patent: Aug. 20, 1991

[54] TWO STAGE VARIABLE ANNULUS SPRAY ATTEMPERATOR METHOD AND APPARATUS

[75] Inventors: Frank E. Garrison, Clinton, Ohio;

[73] Assignee: The Babcock & Wilcox Company, New Orleans, La.

[21] Appl. No.: 499,735

[22] Filed: Mar. 26, 1990

[51] Int. Cl.[5] ..... B01F 3/04

[52] U.S. Cl. ..... 261/78.2; 261/118; 261/DIG. 13

[58] Field of Search ..... 261/DIG. 13, 78.2, 118

[56] References Cited

U.S. PATENT DOCUMENTS

| | | | |
|---|---|---|---|
| 1,622,945 | 3/1927 | Geare et al. | 261/DIG. 13 |
| 1,773,053 | 8/1930 | McDermet | 122/487 |
| 2,171,932 | 9/1939 | Holmboe et al. | 261/78.2 |
| 2,797,904 | 7/1957 | Voorheis | 261/78.2 |
| 2,945,685 | 7/1960 | Bowlus | 261/62 |
| 3,074,697 | 1/1963 | Friedell | 261/78.2 |
| 3,158,666 | 11/1964 | Heller et al. | 261/DIG. 13 |
| 3,219,325 | 11/1965 | Brown | 261/DIG. 13 |
| 3,220,710 | 11/1965 | Forster | 261/69 |
| 3,524,630 | 8/1970 | Marion | 261/78.2 |
| 3,719,524 | 3/1973 | Ripley et al. | 261/DIG. 13 |
| 3,758,081 | 9/1973 | Prudhon | 261/118 |
| 3,981,946 | 9/1976 | Soya et al. | 261/64 R |
| 4,011,287 | 3/1977 | Marley | 261/64 R |
| 4,058,378 | 11/1977 | Saxton | 261/118 |
| 4,071,586 | 1/1978 | Seger | 261/62 |
| 4,073,832 | 2/1978 | McGann | 261/78.2 |
| 4,130,611 | 12/1978 | Brand | 261/66 |
| 4,421,069 | 12/1983 | Diggins | 122/487 |
| 4,442,047 | 4/1984 | Johnson | 261/66 |
| 4,444,697 | 4/1984 | Gater et al. | 261/118 |
| 4,761,077 | 8/1988 | Werner | 261/118 |
| 4,973,337 | 11/1990 | Jokisch et al. | 261/118 |

OTHER PUBLICATIONS

Graham Desuperheaters, Graham Mfgr. Co., Great Neck, N.Y. 11021, Bulletin 9137.

How to Put Together Systems for Today's Desuperheater Needs, Power Magazine, vol. 130, No. 1, Jan. 1986, O'Keefe, pp. 13–20, Entire Article.

*Primary Examiner*—Tim Miles

*Attorney, Agent, or Firm*—Vytas R. Matas; Robert J. Edwards; Eric Marich

[57] ABSTRACT

An attemperator for spraying water into a flow of steam utilizes a spray nozzle head having an inner Venturi passage. The head defines an annulus around the passage with an annular opening communicating the annulus with the interior of the passage. Side walls of the annular opening are inclined to converge at a focal point near the center of the passage. Steam passing through the Venturi passage picks up the spray which is finely atomized. A sleeve is threaded to the head for adjusting the size of the annular opening.

13 Claims, 3 Drawing Sheets

TWO STAGE VARIABLE ANNULUS SPRAY ATTEMPERATOR METHOD AND APPARATUS

FIELD AND BACKGROUND OF THE INVENTION

The present invention relates in general to steam generators and, in particular, to a new and useful attemperator for steam generators which utilizes an annular opening centered around a steam passage to supply atomized liquid in the steam passage.

The use of water injection via direct contact spray attemperation apparatus to control steam temperature is well known in the art. Several designs for spray attemperators and nozzles are disclosed in *Power*, January 1986, pages 13–20, "How to put together systems for today's desuperheater needs", O'Keefe. FIG. 2 thereof discloses a conventional single orifice, non-adjustable spray nozzle. Steam flow is around the nozzle, and either a whirling action or a cone-shaped piece protruding part way into the orifice assists in atomization of the spray water.

FIG. 3 of the O'Keefe article discloses a variable orifice spray nozzle in which spray water supply pressure interacts with an opposing spring force in the nozzle to determine the position of a conical spray plug. Rather than focusing the spray water at a point, this design sprays the water outwardly in all directions. According to page 17 of the O'Keefe article, desuperheaters of this type are mounted to face upstream with respect to the direction of steam flow, delivering water into the steam, which turns the droplets around to carry them downstream and evaporate them.

FIG. 4 of O'Keefe discloses a combination of an external control Valve with a multiple-nozzle or orifice array to widen the turndown range of the device. FIG. 6 of O'Keefe is a variation of FIG. 4 where six spray nozzles are each fed by seven small orifices to further enhance turndown. In both designs, the valve stem extends down into the water tube located inside the steam carrying pipe and functions as a shutoff for the series of orifices. FIG. 5 of O'Keefe discloses an arrangement using multiple O'Keefe discloses the use of 10 to 20 orifice holes of varying sizes which are uncovered as an actuator raises the valve plug to expose the orifices.

FIGS. 8 and 9 of O'Keefe disclose the use of steam to enhance atomization of the spray water. In FIG. 8, a portion of the steam in the line flows through a Venturi section of the spray nozzle head itself to atomize the spray water which is introduced into the passage by a plurality of small orifices, rather than via an annular opening as in the present disclosure. FIG. 9 employs an external source of high pressure steam to shatter water being introduced into the steam flow. FIG. 10 of O'Keefe discloses a check-valve type of apparatus whose heavy plug, guided to prevent anything but limited vertical movement, rises and falls in response to the flow of steam. The floating plug design is also shown in another embodiment in FIG. 11, which uses a guide stem that also rises and falls in response to the steam flow. It should be noted that while an annular opening is provided in this device, it is the steam which passes through the annular opening, rather than the spray water.

The apparatus of FIG. 12, in O'Keefe, is again a steam conditioning type of valve, where the water enters the steam flow downstream of the valve seat and handles steam in a manner comparable to a cage-type PRV. FIG. 13 of O'Keefe is a low noise type in which multiple orifice holes are used, while the device of FIG. 14 of O'Keefe employs a contoured throttling plug to proportion the spray water in response to steam need.

U.S. Pat. No. 3,981,946 to Soya, et al, discloses an orifice forming member, having a slit and located in a Venturi section which encircles a central passageway. As steam flows through the central passageway, the Venturi effect pulls the water into the steam. In contrast to the present invention, the annular opening is in the walls of the pipe, rather than on the internal portion of a nozzle inserted into a pipe, and does not attempt to focus the water into a central portion of the central passageway.

U.S. Pat. No. 3,220,710 to Forster, discloses a self-regulating attemperator using a movable piston assembly which moves in response to steam pressure and which is quite similar to those described in FIGS. 11–14 of the O'Keefe article. However, while the water flows into the steam via an annular opening, the steam does not flow through a central passage around which the water is introduced at an angle to focus the water as in the present disclosure.

U.S. Pat. No. 4,442,047 to Johnson, and U.S. Pat. No. 4,130,611 to Brand, disclose multi-nozzle spray desuperheaters quite similar to those shown in FIGS. 4, 6 and 7 of the O'Keefe article.

U.S. Pat. No. 2,945,685 to Bowlus, and U.S. Pat. No. 4,071,586 to Seger disclose variable orifice desuperheaters. Bowlus utilizes a ball which is uplifted by the flow of steam off of its seat. As the ball is lifted, the high velocity steam passing by the water inlets to the device creates an atomizing action which serves to break up the water into fine droplets. Seger uses a cylindrical plug-type assembly slidably guided in a housing which is designed to be more compact in terms of space and use of material than previous designs.

U.S. Pat. No. 1,773,053 to McDermet discloses an arrangement of wire mesh and baffles introduced into the steam path and into which the spray water is introduced.

U.S. Pat. No. 4,011,287 to Marley discloses a labyrinth type of spray conditioning valve which injects the spray water upstream of the labyrinth disk stack.

U.S. Pat. No. 4,421,069 to Diggins discloses a desuperheater spray liner assembly supported inside a header of a steam boiler so as to accommodate longitudinal and radial expansion and contraction of the liner within the header.

SUMMARY OF THE INVENTION

The present invention provides an improved spray attemperator assembly for controlling steam temperature in a boiler, which incorporates a two stage variable annulus spray nozzle head. The spray nozzle head extends into a section of pipe containing the steam flow which is to be cooled by the injection of spray liquid, i.e. water, through the nozzle.

The spray nozzle head is designed to permit steam flowing in the pipe to flow through a central Venturi passage in the spray nozzle head, as well as around it, to assist in atomization of the spray, liquid.

In accordance with the present invention, instead of using a single or multiple arrangement of orifices in a spray nozzle head, an annular opening is provided around a central Venturi passage which is used to admit the spray liquid into the steam. The annular opening is manually adjustable by means of an annular adjustment sleeve which screws into the spray nozzle head. This focuses the spray liquid to a focal point to effect dispersion of the spray liquid into the steam. The annular adjustment sleeve is advantageously tack welded at its selected position to hold the sleeve in place. Readjustment of the sleeve can easily be accomplished by cutting the tack weld, rotating the annular adjustment sleeve, and re-tacking the sleeve to the spray nozzle head.

The present invention has advantages of reduced waterside pressure drop due to the annular spray water opening and of decreased steam-side pressure drop due to the flow-through design of the spray nozzle head. In addition, water flow tests on a plastic model of the inventive spray nozzle indicate that a much finer atomization of the spray water, which produces a fine mist rather than droplets, can be achieved with roughly double the flow capacity of conventional, that is, non-flow-through single orifice style spray nozzles, at the same waterside pressure drop. This is especially advantageous since the present invention can be used in situations where the quantity of spray water would have otherwise required a tandem (two spray nozzles in series) spray attemperator.

Accordingly, one aspect of the present invention is to provide an attemperator which comprises: steam passage means defining a steam passage for the flow of steam into which liquid is to be sprayed; liquid passage means defining an annular opening centered around the steam passage for supplying liquid in a focused spray into the flow of steam; and liquid supply means for supplying liquid to the annular opening.

Another aspect of the invention is to provide a method of spraying liquid into a flow of steam, comprising providing an annular opening having a centered steam passage therethrough, supplying a liquid to the annular opening to form a spray of liquid and focusing the spray of liquid centrally into the steam passage.

A still further aspect of the present invention is to provide an attemperator which is simple in design, rugged in construction, and economical to manufacture.

The various features of novelty which characterize the invention are pointed out with particularity in the claims annexed to and forming a part of this disclosure. For a better understanding of the invention, its operating advantages and specific aspects attained by its uses, reference is made to the accompanying drawings and descriptive matter in which a preferred embodiment of the invention is illustrated.

DESCRIPTION OF THE PREFERRED EMBODIMENT

Figure 1:
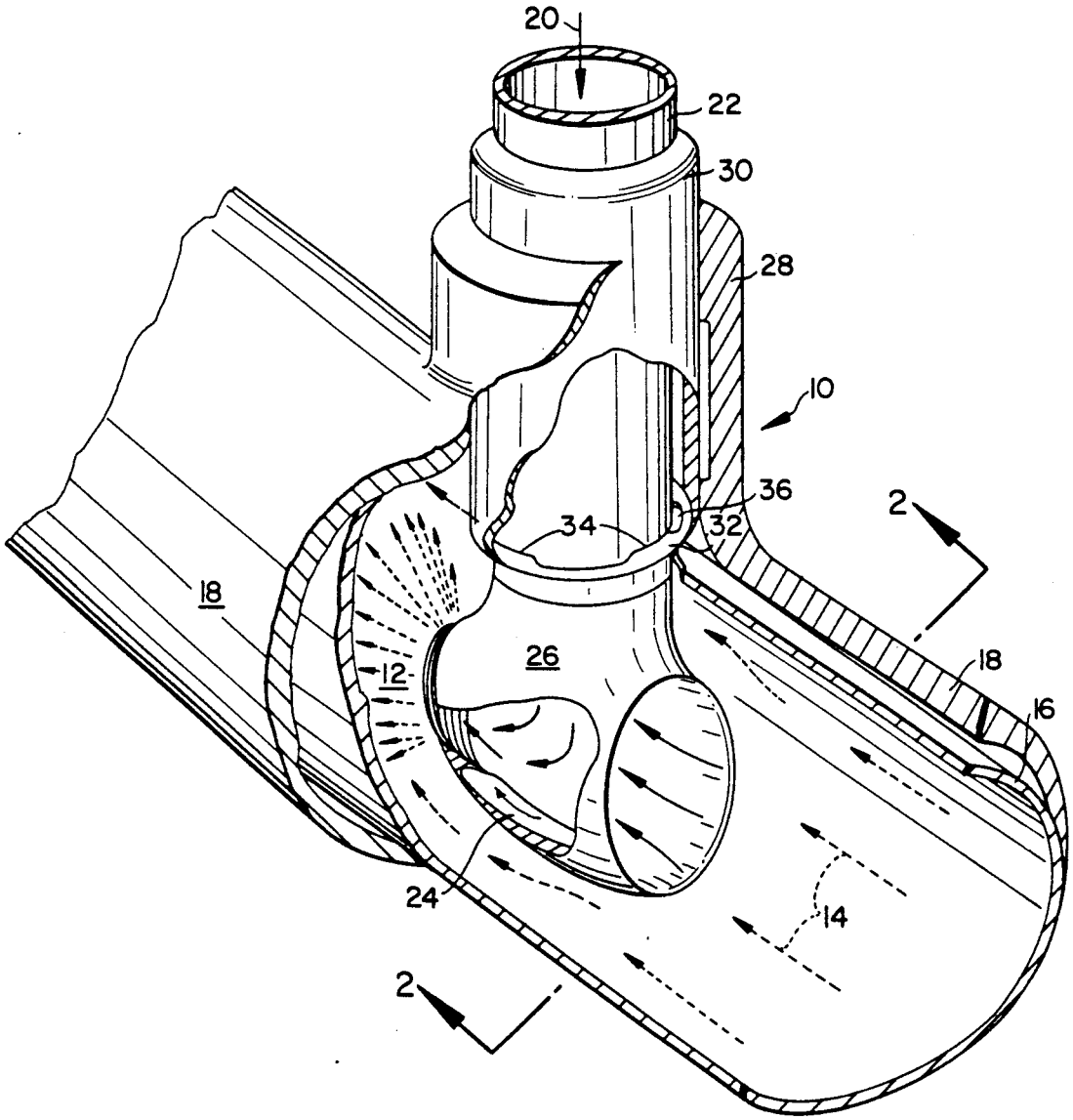
FIG. 1 is a perspective view, with portions cut away, of the attemperator of the present invention.

Referring to the drawings in particular, the invention embodied in FIG. 1 comprises an attemperator generally designated 10 for forming and focusing a spray of water 12 into a flow of steam 14. The steam flow 14 passes through a liner 16 disposed within an attemperator body 18.

Water flows in the direction of arrow 20 through a water supply conduit 22 and 24 is supplied into an annulus 24 defined by an attemperator spray nozzle head 26. Spray nozzle head 26 which is integrally connected, for example, by welding, to water supply conduit 22, is supported, preferably centrally, in the steam flow 14 by a nozzle head support 28 integrally connected to and extending radially from the attemperator body 18, and an intermediate retainer sleeve 30. A diaphragm 32 is provided at the lower end of retainer sleeve 30 which has lands 34 which embrace the conduit 24. Steam escape passages or openings 36 are provided between lands 34 to permit the escape of some steam to and from liner 16.

Figure 3:
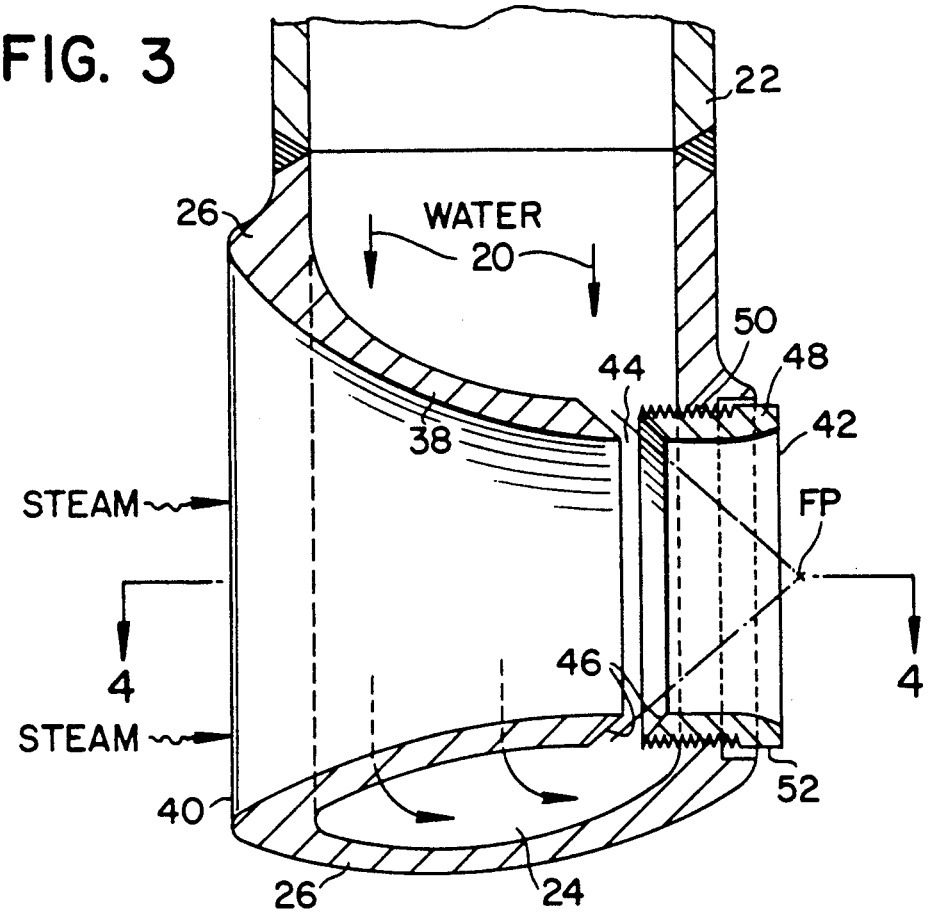
FIG. 3 is a sectional view taken along line 3—3 of FIGS. 2 and 4.
Figure 4:
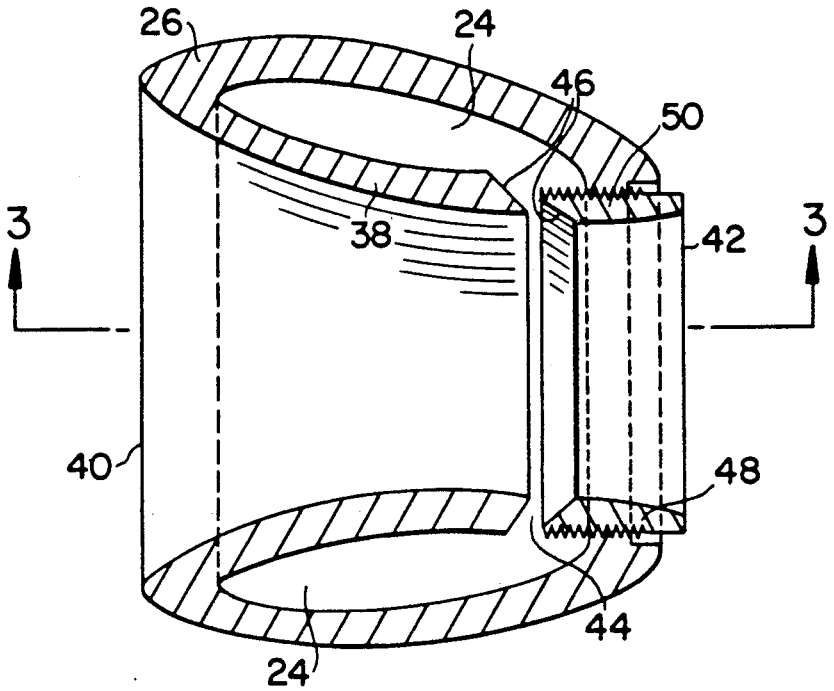
FIG. 4 is a sectional view taken along line 4—4 of FIG. 3.

As best shown in FIGS. 3 and 4, spray nozzle head 26 defines annulus 24 around a central Venturi member 38 having a large diameter inlet opening 40 for receiving the oncoming flow of steam and a small diameter outlet opening 42 for discharging a flow of steam. An annular opening 44 extends centrally around the steam flow passing through Venturi 38 and communicates the annulus 24 with the interior of the Venturi member 38. Side walls 46 of annular opening 44 are inclined with respect to the central axis through Venturi member 38 so that any spray of liquid passing through the annular opening 44 is focused toward a central focal point FP, disposed centrally in the flow of steam passing through Venturi member 38. One inclining side wall 46 is disposed at the downstream end of a portion of Venturi member 38 which is formed integrally with spray nozzle head 26 and the other inclining side wall 46 is disposed on a threaded adjustment sleeve 48 which is threaded into a corresponding threaded opening 50 in spray nozzle head 26. Adjustment sleeve 48 can be rotated to select a desired size of the annular opening 44 and tack welded in place at 52, for example. This locks sleeve 48 to spray nozzle head 26 to fix the size of the annular opening 44. For adjustment, tack weld 52 may be cut to permit rotation of sleeve 48 to change the size of the annular opening 44.

Figure 2:
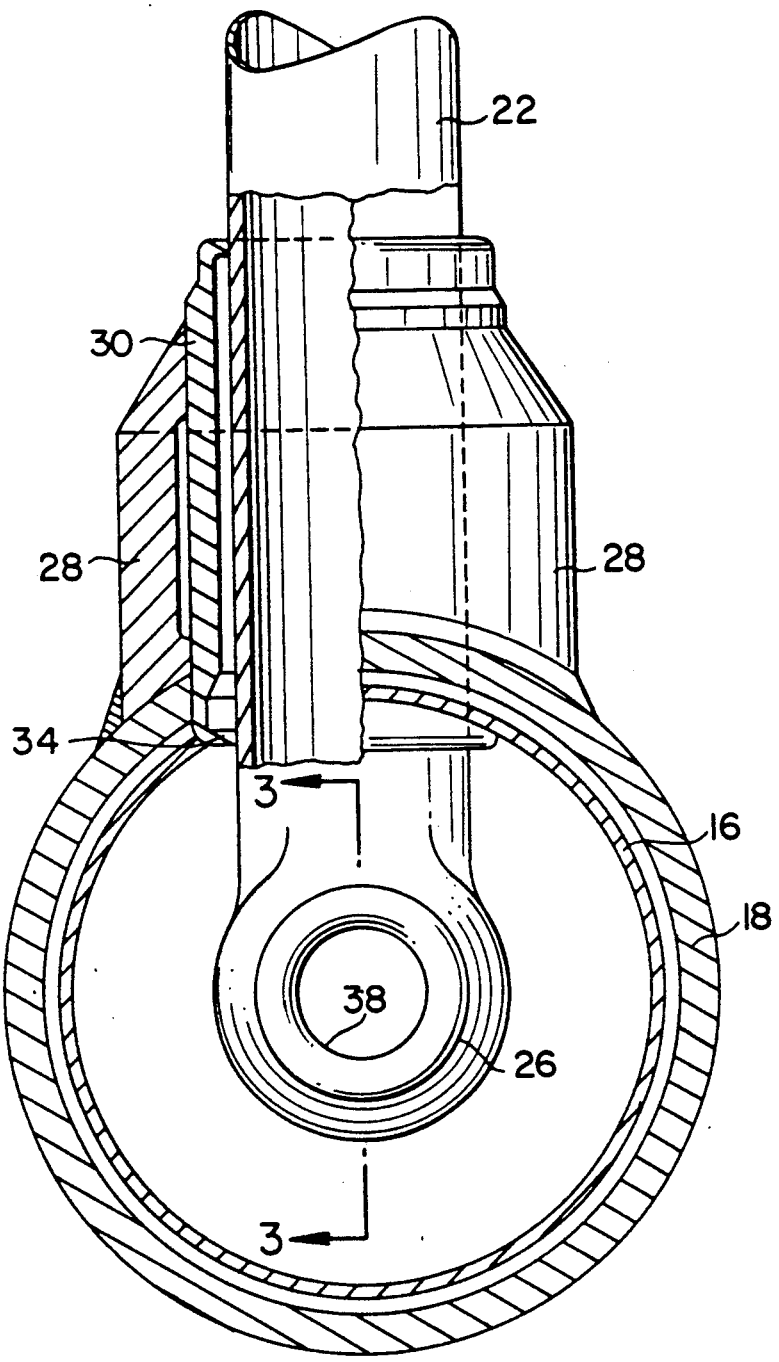
FIG. 2 is a sectional view, partly in elevation, taken along line 2—2 transversely to the flow of steam in the attemperator of FIG. 1.

As best shown in FIGS. 1 and 2, spray nozzle head 26 is supported in cantilever fashion on the attemperator body 8 to reduce the obstruction presented to the steam flow to a minimum. Steam smoothly flows through Venturi member 38 and around spray nozzle head 26. The steam flow through Venturi member 38 picks up the spray of water.

The cantilever mounting of the spray nozzle head 26 reduces vibrations. This is further enhanced by providing the support of the diaphragm 32 and its lands 34 at a position near the liner 16. The openings 36 through the diaphragm 32 of retainer sleeve 30 allow steam to evacuate the nozzle area if water is entrapped in this area. The openings 36 allow the resulting flashing steam to escape the otherwise closed chamber.

The waterside pressure drop of flow through the spray nozzle head 26 has been shown to be reduced through the use of the annulus 24, when compared with an orifice hole. This has been demonstrated with a plastic flow model of the invention.

The high spray water velocity and impaction at a focal point located so that the spray can expand unimpeded, produces exceedingly fine spray droplets and a good spray pattern. Due to the higher velocity through the annulus 24, little effect is produced on the quality of the spray during spray water volume changes. Flow of steam through the aerodynamically shaped spray nozzle head 26 also reduces resistance to the steam flow. The adjustment sleeve 48 provides a fine tuning of the spray water velocity to suit a given situation. This adjustment can be made through an inspection opening (not shown) in the attemperator body 18 and liner 16 with minimal effort.

Advantageously, the spray nozzle head 26 can be cast with the remaining parts being hot formed and/or machined from commercially available material.

While in accordance with the provisions of the statutes, there is illustrated and described herein specific embodiments of the invention, those skilled in the art will understand that changes may be made in the form of the invention covered by the claims, and certain features of the invention may sometimes be used to advantage without a corresponding use of the other features. For example, the attemperator of the present invention can be employed in new construction or as a replacement assembly for existing steam generator units. Similarly, the unique spray nozzle head of the present invention can be retrofitted and adapted to existing spray attemperator bodies as a replacement in kind or to achieve reduced water and/or steam side pressure drop operating characteristics as needed. Accordingly, it is understood that all such modifications and improvements have been deleted herein for the sake of conciseness and readability but are properly within the scope of the following claims.

The embodiments of the invention in which an exclusive property or privilege is claimed are defined as follows:

1. An attemperator for spraying liquid into a flow of steam, comprising:

steam passage means including a Venturi member having a large diameter inlet end and a small diameter outlet end for defining a steam passage for the flow of steam into which liquid is to be sprayed;

liquid passage means defining an annular opening centered around said steam passage for supplying and for focusing liquid into a spray, spraying centrally into the flow of steam; and liquid supply means operatively connected to said annular opening for supplying liquid thereto, said liquid supply means including a spray nozzle head defining an annulus around said Venturi member, said annular opening extending between said annulus and said steam passage defined by said Venturi member, said Venturi member including a first portion integrally connected to said spray nozzle head and carrying said large diameter inlet end, said first portion of said Venturi member having an edge spaced away from said large diameter inlet end which is inclined with respect to an axis of said Venturi member toward a focal point disposed centrally in the flow of steam passing through said Venturi member and downstream of said small diameter outlet end.

2. An attemperator according to claim 1, further including an adjustment sleeve threaded to said spray nozzle head for adjusting the size of said annular opening, said adjustment sleeve carrying said small diameter outlet end of said Venturi member and having an edge spaced away from said small diameter outlet end which is inclined to extend substantially toward said focal point said edges of said first portion and said adjustment sleeve defining said annular opening therebetween for focusing the spray of liquid centrally into the flow of steam passing through said Venturi member.

3. An attemperator according to claim 1, wherein said liquid supply means include a liquid conduit fixed to said spray nozzle head, an attemperator body carrying said liquid conduit and defining a steam conduit, said spray nozzle head being suspended in said steam conduit in cantilever fashion from said liquid conduit.

4. An attemperator according to claim 3, including a liner within said attemperator body for the passage of steam therethrough, said spray nozzle head being centrally disposed within said liner.

5. An attemperator according to claim 3, including a retainer sleeve having a diaphragm engaged with said liquid conduit near a wall of said attemperator body, said retainer sleeve being supported by said attemperator body.

6. An attemperator according to claim 5, wherein said retainer sleeve defines a space with an exterior of said liquid conduit and includes passages through said diaphragm for the escape of steam.

7. An attemperator according to claim 6, including means operatively connected to said spray nozzle head for fixing the size of said annular opening.

8. A method of spraying liquid into a flow of steam, comprising:

providing a spray nozzle head defining an annulus centered around a Venturi constriction steam passage therethrough;

providing an annular opening in said spray nozzle head disposed in and intermediately along said Venturi constriction steam passage connecting said annular and the central steam passage;

supplying a spray of liquid to said annulus and passing the spray of liquid through said annular opening into the steam passage;

focusing the spray of liquid towards a central focal point disposed centrally in the flow of steam passing through the steam passage; and adjusting the size of said annular opening in an axial direction parallel to the flow of steam passing through the steam passage for adjusting the spray.

9. A method according to claim 8, including passing steam both through the Venturi constriction and around the Venturi constriction, steam passing through the Venturi constriction picking up the spray of liquid.

10. A method according to claim 8, including locating said annular opening within said flow of steam and substantially at the center thereof.

11. An attemperator for spraying liquid into a flow of steam, comprising:

steam passage means including a Venturi member having a large diameter inlet end and a small diameter outlet end for defining a steam passage for the flow of steam into which liquid is to be sprayed;

liquid passage means defining an annular opening centered around said steam passage means for supplying and for focusing liquid into a spray, spraying centrally into the flow of steam;

liquid supply means operatively connected to said annular opening for supplying liquid thereto, said liquid supply means including a spray nozzle head defining an annulus around said Venturi member, said annular opening extending between said annulus and the interior of said Venturi member, a liquid conduit fixed to said spray nozzle head, an attemperator body carrying said liquid conduit and defining a steam conduit, said spray nozzle head being suspended in said steam conduit in cantilever fashion from said liquid conduit; and a retainer sleeve having a diaphragm engaged with said liquid conduit near a wall of said attemperator body, said retainer sleeve being supported by said attemperator body.

12. An attemperator for spraying liquid into a flow of steam, comprising:

steam passage means including a Venturi member having a large diameter inlet end and small diameter outlet end for defining a steam passage for the flow of steam into which liquid is to be sprayed;

liquid passage means defining an annular opening centered around said steam passage means for supplying and for focusing liquid into a spray, spraying centrally into the flow of steam;

liquid supply means operatively connected to said annular opening for supplying liquid thereto, said liquid supply means including a spray nozzle head defining an annular around said Venturi member, said annular opening extending between said annulus and the interior of said Venturi member, a liquid conduit fixed to said spray nozzle head, an attemperator body carrying said liquid conduit and defining a steam conduit, said spray nozzle head being suspended in said steam conduit in cantilever fashion from said liquid conduit; and a retainer sleeve having a diaphragm engaged with said liquid conduit near a wall of said attemperator body, wherein said retainer sleeve is supported by said attemperator body, defines a space with an exterior of said liquid conduit, and includes passages through said diaphragm for the escape of steam.

13. An attemperator for spraying liquid into a flow of steam, comprising:

steam passage means including a Venturi member having a large diameter inlet end and a small diameter outlet end for defining a steam passage for the flow of steam into which liquid is to be sprayed;

liquid passage means defining an annular opening centered around said steam passage means for supplying and for focusing liquid into a spray, spraying centrally into the flow of steam;

liquid supply means operatively connected to said annular opening for supplying liquid thereto, said liquid supply means including a spray nozzle head defining an annulus around said Venturi member and having means operatively connected thereto for fixing the size of said annular opening, said annular opening extending between said annulus and the interior of said Venturi member, a liquid conduit fixed to said spray nozzle head, an attemperator body carrying said liquid conduit and defining a steam conduit, said spray nozzle head being suspended in said steam conduit in cantilever fashion from said liquid conduit; and a retainer sleeve having a diaphragm engaged with said liquid conduit near a wall of said attemperator body, wherein said retainer sleeve is supported by said attemperator body, defines a space with an exterior of said liquid conduit and includes passages through said diaphragm for the escape of steam.

* * * * *